United States Patent [19]

Breck, Jr.

[11] 4,287,842

[45] Sep. 8, 1981

[54] AUTOMATIC BELT LOOP TACKER

[76] Inventor: Louis W. Breck, Jr., Eight Joe Turner Ct., El Paso, Tex. 79915

[21] Appl. No.: 76,085

[22] Filed: Sep. 17, 1979

[51] Int. Cl.[3] ..... D05B 23/00

[52] U.S. Cl. ..... 112/121.27; 112/104

[58] Field of Search ..... 112/121.27, 121.26, 112/121.11, 121.12, 121.15, 104, 113

[56] References Cited

U.S. PATENT DOCUMENTS

| | | | |
|---|---|---|---|
| 3,095,842 | 7/1963 | Metzger | 112/121.27 |
| 3,980,033 | 9/1976 | Frost et al. | 112/121.27 X |
| 4,005,663 | 2/1977 | Barthelmes | 112/121.27 X |
| 4,048,931 | 9/1977 | Hodgins | 112/104 X |
| 4,114,544 | 9/1978 | Miyachi et al. | 112/104 |
| 4,137,857 | 2/1979 | Miyachi et al. | 112/121.27 |

*Primary Examiner*—H. Hampton Hunter

*Attorney, Agent, or Firm*—Allen D. Brufsky

[57] ABSTRACT

Sewing apparatus for automatically feeding individual belt loops to a folding mechanism where opposite transverse ends of each of the belt loops is folded back upon itself. The loops are then delivered in tandem to a tacker where the folded ends are automatically stitched to a garment.

11 Claims, 8 Drawing Figures

AUTOMATIC BELT LOOP TACKER

BACKGROUND OF THE INVENTION

1. Field of the Invention

This invention relates to sewing apparatus, and more particularly, apparatus for delivering, folding, and stitching belt loops to a garment.

2. Description of the Prior Art

Heretofore, it was common for belt loops to be sewn directly to the outside of work clothes, such as jeans. The individual loops were taken by a sewing machine operator, folded at opposite longitudinal ends, and stitched on their outside to the jeans. The manual handling of the individual loops and positioning of the same on the jeans is a time-consuming, production reducing process.

The apparatus of the present invention delivers the belt loops, folds them at their opposite longitudinal ends, and stitches them to the outside of the garment at the opposite longitudinally folded ends, all automatically, thereby reducing valuable production time and operator tedium associated with sewing belt loops to a garment.

In my prior patent, U.S. Pat. No. 4,034,690 issued July 12, 1977 entitled "Apparatus and Method for Forming Belt Loops", I disclose an apparatus and method for making belt loops from discrete, pre-sized plies of fabric material. The loops are collated in a bundle or spool so that they can be removed and sewn to garment pieces cut from adjacent areas on a fabric lay to maintain the same shading characteristics of the component pieces of the garment throughout its construction. The apparatus and method for collating and bundling the belt loops is disclosed in my prior patents, U.S. Pat. No. 4,149,709 issued Apr. 17, 1979 entitled "Apparatus and Method for Collating and Bundling Belt Loops" and U.S. Pat. No. 4,135,707 issued Jan. 23, 1979, also entitled "Apparatus and Method for Collating and Bundling Belt Loops".

The present apparatus is specifically adapted to remove the individual belt loops from the collated spool bundle, deliver them to a folder which folds their opposite ends, and then sews them to the exterior of a garment. While the apparatus is specifically adapted to operate with such a spool bundle, it will be obvious from the following disclosure that the apparatus can be used to deliver, fold and stitch any discrete one or more belt loops to a garment such as a pair of jeans, regardless of their source and the manner in which they are formed.

SUMMARY OF THE INVENTION

The apparatus of the present invention includes a conveyor handling section for feeding individual loops to a folder and sewing head. The spool bundle of belt loops is loaded onto a reel positioned above the conveyor, which comprises an endless belt. The spool includes a thread which is used to unwind the spool and deposit the loops wound on the spool onto the conveyor belt at spaced locations. The thread on the spool is fed down the middle of the conveyor belt and underneath the conveyor, through a loop guide which turns it ninety degrees, and is then wound upon a motorized spindle. Turning of the spindle pulls the thread and unwinds the loops from the spool and causes them to seat upside down at spaced locations on the conveyor belt.

The conveyor feeds the loops past a guide member mounted on at the front of the conveyor which causes the individual loops on the conveyor to be serially turned rightside up and deposited on a reciprocable L-shaped slide mounted beneath the conveyor. The L-shaped slide is provided with channel-shaped transverse ends. As each loop is deposited on the slide, a microswitch is activated, stopping the motorized spindle. At the desired time, the slide moves forward into mating engagement with a plastic block having an open front and open transverse ends. The slide, upon mating with the block, closes the front of the block forming a housing for the loop deposited on the slide. A pulse of air is then transmitted transversely through the channel ends of the slide and housing enclosure formed by the block and slide, or ninety degrees to the direction of movement of the slide, to move the loop and complete its delivery to a folding mechanism.

The loop is blown through the channel formed in one transverse end of the housing onto a platform on one end of a slidable plate, reciprocably mounted in a support plate. A cam-actuated folding mechanism then folds each transverse end of the individual belt loop back upon itself.

The folding mechanism includes a cam plate reciprocably movable in a slot on the slidable plate by an air cylinder mounted beneath the plate. The cam plate has a pair of elongated spiral slots each of which receives a cam follower mounted on an elongated rod. The rods are parallel to each other and have a folder at one end. The opposite end of each rod is mounted on an upright block fixed to the slidable plate in the support plate. Movement of the cam plate forwardly by the piston of the air cylinder causes rotation of the relatively stationary rods via the camming action between the cam followers on each rod and the camming slots on the movable cam plate. This causes downwardly projecting fingers on the end of each folder to pivot inwardly about the belt loop to turn each end of the belt loop on the platform in front of the folding mechanism back upon itself.

Continued forwrd movement of the cam plate will cause it to contact a stop positioned in the slot in the slidable plate in front of the cam plate. This stop is connected to the slidable plate so that continued movement of the air cylinder piston will cause the entire folder mechanism supported on the slidable plate to move forwardly along with the cam plate. This causes the platform holding the folded belt loop forward and the loop is deposited beneath the foot of a sewing head or tacker. A clamp associated with the tacker is pivoted downwardly to clamp the folded belt loop beneath the foot of the tacker.

The motion of the air cylinder associated with the folding mechanism is then reversed. This causes the cam plate to reverse its direction of movement and retract. Retraction of the cam plate in the slot in the slidable plate first causes the rods holding the folder fingers to rotate back to their initial position, through the camming action between the followers on the relatively stationary rods and spiral slots on the relatively movable cam plate resulting in dropping of the loop. Continued rearward movement of the cam plate in the slot in the slidable plate causes the cam plate to strike a second stop in the rear of the slot in the slidable plate to then move the slidable plate and folder mechanism assembly back to its initial position to receive another belt loop.

One transverse end of the loop is then sewn or tacked to a garment positioned beneath the sewing head or tacker. After this sewing operation is completed, a second air cylinder associated with the tacker has its piston moved horizontally to move the loop and its entire support platform beneath the foot of the tacker forwardly, to reposition the opposite transverse end of the loop beneath the sewing head of the tacker. The opposite transverse end of the loop is then sewn to the garment.

The downwardly pivotable clamp is then released so that the garment can be removed from beneath the tacker with the sewn loop on it and repositioned to receive the next loop. The platform associated with the tacker is then retracted by the horizontal air cylinder associated with the tacker to be realigned with the folder so as to be in a position to receive a subsequent loop for tacking to the garment.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
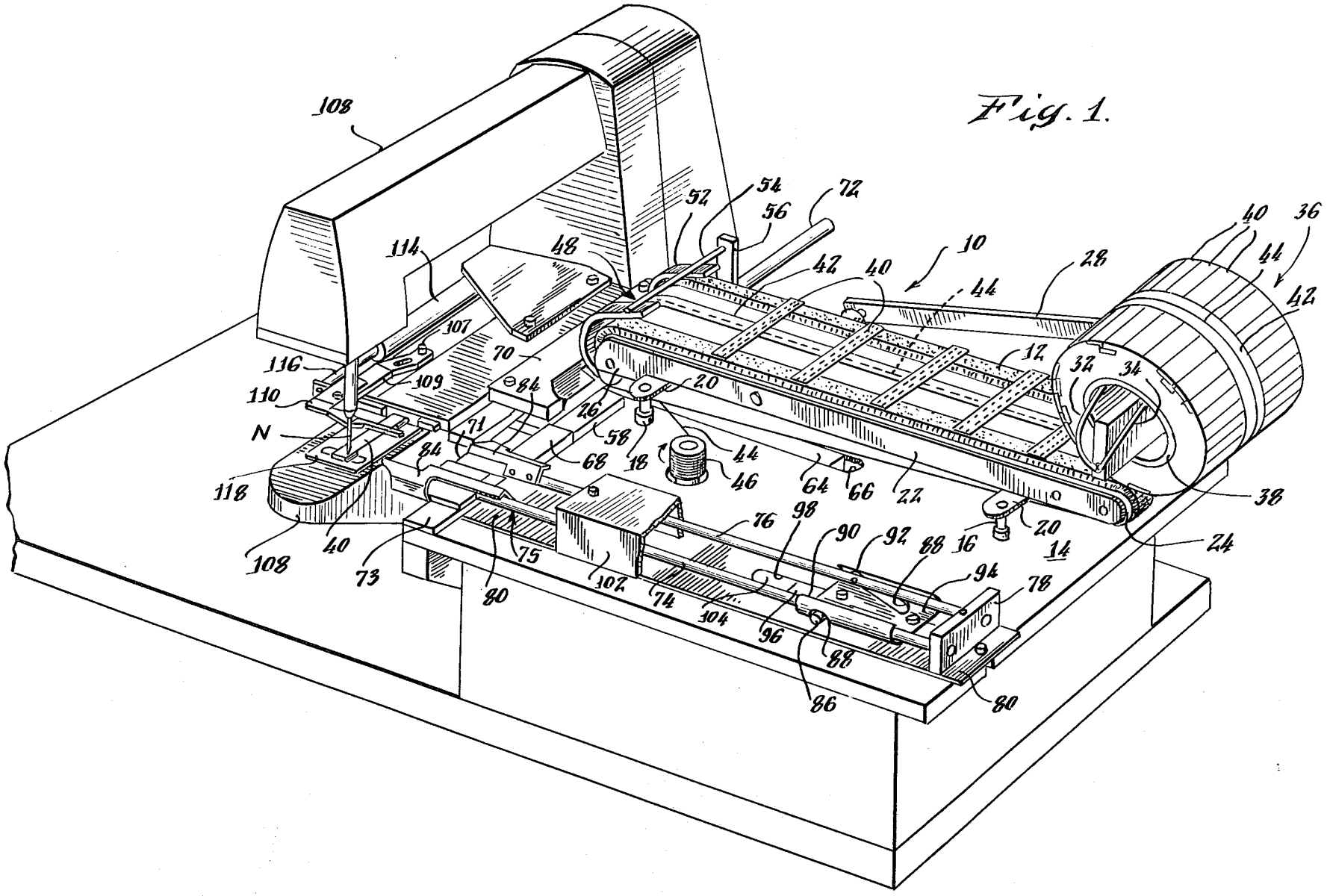
FIG. 1 is a perspective view of the automatic belt loop tacker apparatus of the present invention.

Referring now to the drawings in detail, wherein like numerals indicate like elements throughout the several views, the automatic belt loop tacker apparatus of the present invention is indicated in FIG. 1 by the numeral 10.

Apparatus 10 includes an endless conveyor belt 12 supported in spaced relation above a main support plate 14 by a plurality of threaded posts 16 and 18. The posts 16 and 18 are received in ears 20 connected to a rectangular frame 22 for the conveyor belt 12. Endless conveyor belt 12 is entrained about rollers 24 and 26 connected to the opposite ends of the rectangular framework 22.

An arm 28 is pivotably mounted on framework 22 and carries a spool support at its opposite end consisting of a block 30 mounting a pair of spring fingers 32 and 34 which form a V-shaped configuration when viewed in side elevation. A spool of belt loops 36 wound on a core 38 is inserted over the V-shaped spring fingers 32 and 34 which retains them on arm 28 above the surface of conveyor belt 12.

The individual belt loops 40 on spool 36 are retained wound about core 38 between a tape 42 and a thread 44. When the spool 36 is placed upon the spring fingers 32 and 34, the thread 44 is unwound and run down the center of the conveyor. The thread 44 is positioned beneath the conveyor and enters a guide (not shown) which bends it at an angle. The end of the thread 44 is wound about a motorized spindle 46 which extends upwardly through support plate 14.

Rotation of the spindle in a clockwise direction as viewed in FIG. 1, will wind the thread 44 upon the spindle 46 at the same time unwinding the spool of belt loops 36 and depositing the individual loops in spaced relation along the top run of belt 12. The frictional contact between thread 44 and the top run of conveyor 12 causes the conveyor 12 to move about idler rollers 24 and 26 on frame 22.

The individual belt loops 40 are deposited on the top run of conveyor 12 upside down. The conveyor 12 feeds each individual belt loop 40 past an angular guide member 48 consisting of a pair of arcuate fingers 50 and 52 at the front of the conveyor 12. The arcuate fingers 50 and 52 are connected together by a rod 54 mounted on an upright post 56 carried by one side member of frame 22. The guide fingers 50 and 52 cause each individual belt loop 40 to be turned right-side up about the front of conveyor 12 and deposited on an L-shaped plate 58 reciprocably slidable on support plate 14 by means of an air cylinder 60 mounted beneath the plate 14.

Air cylinder 60 has a piston 62 connected to a slide rod 64 slidable within an elongated slot 66 formed in plate 14 beneath conveyor belt 12. Slide rod 64 is connected at its opposite end to L-shaped slide plate 58 onto which each individual belt loop 40 is deposited. L-shaped slide plate 58 includes a channel member 68 at each end for a purpose which will be described hereinafter.

Figure 4:
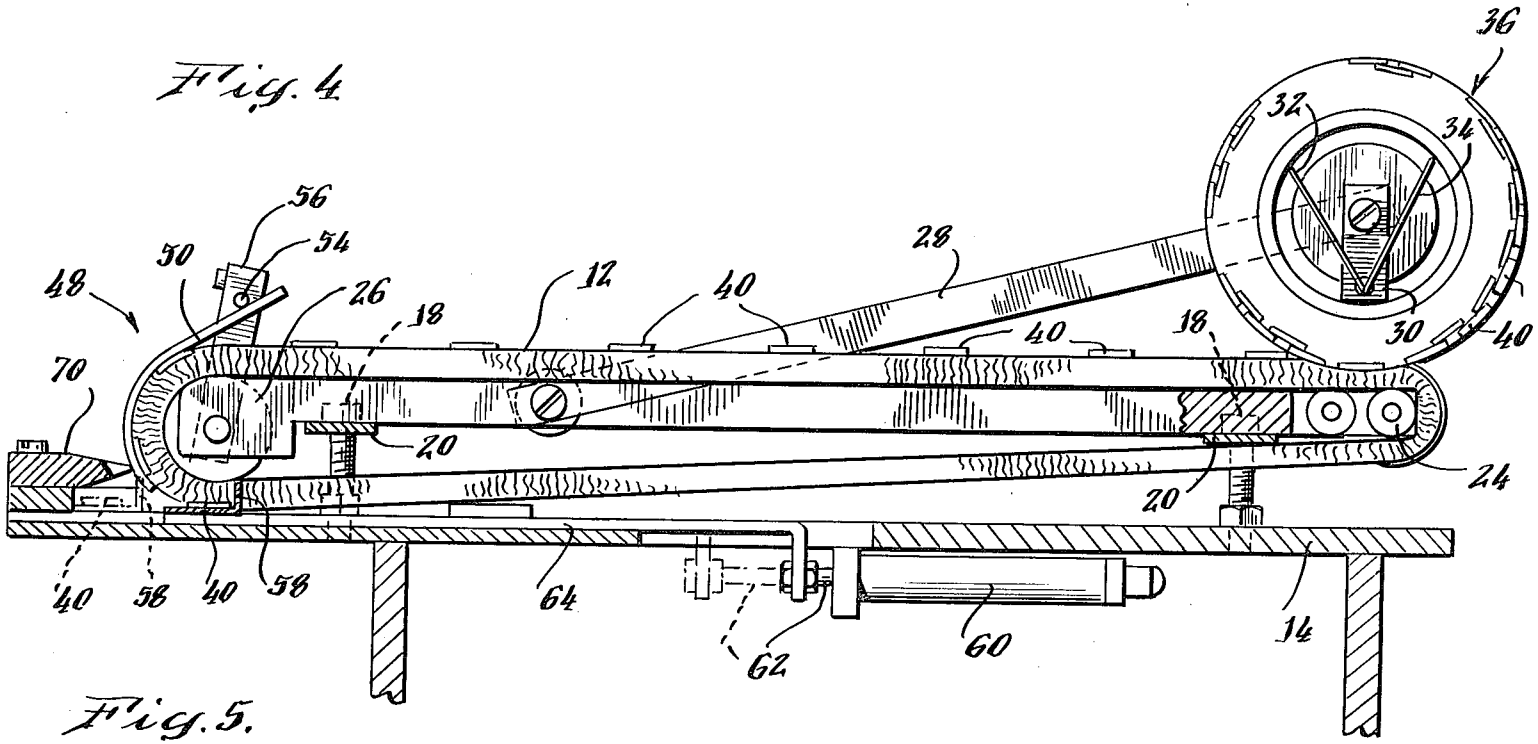
FIG. 4 is a cross-sectional view of the apparatus taken substantially along the plane indicated by line 4—4 of FIG. 3.

The deposit of the belt loop 40 from conveyor 12 onto the L-shaped slide plate 58 actuates a microswitch (not shown). The switch stops rotation of the motorized spindle. Air cylinder 60 is then actuated to move piston 62 forward as indicated in phantom lines in FIG. 4, sliding plate 58 forwardly towards a plastic block 70 mounted on the front end of plate 14. Slide plate 58 encloses the space between block 70 and the top support plate 14 so as to form with the block and support plate an enclosure having open lateral ends defined by opposed transverse channels 68 on slide plate 58.

When belt loop 40 is placed within the enclosure formed by block 70 and slide plate 58, a pulse of air is transmitted through a conduit 72 into the enclosure through one channel 68 to push the belt loop 40 laterally through the opposite channel 68 onto a support platform 73 mounted on the front of a slidable support plate 80 in main support plate 14, which carries a folder mechanism 75. The belt loop 40 is now positioned ready to have its transverse ends folded prior to being tacked to a garment.

Figure 7:
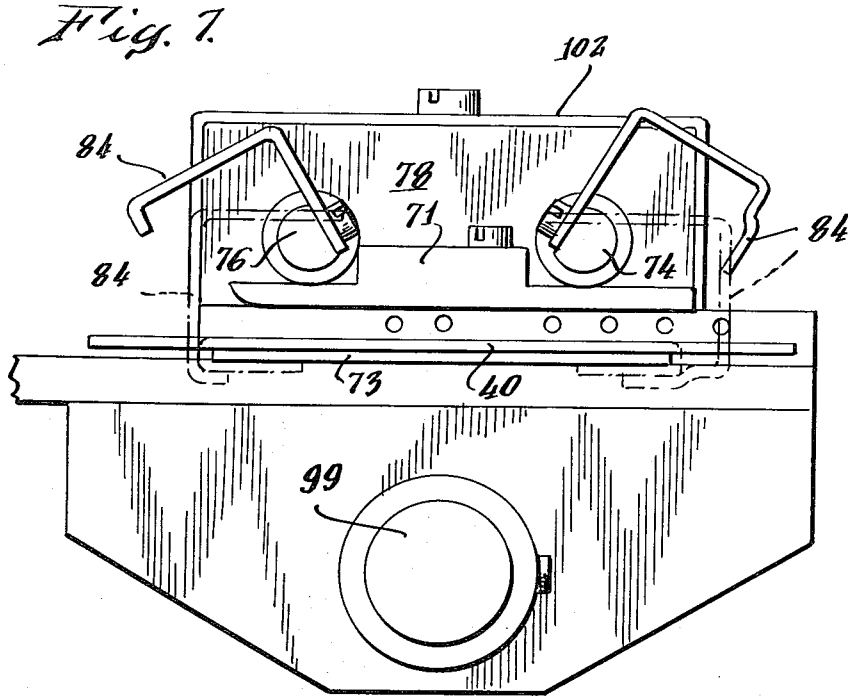
FIG. 7 is a cross-sectional view taken substantially along the plane indicated by line 7—7 of FIG. 5.

The folder mechanism 75 includes a pair of parallel, spaced rods 74 and 76 fixed to a pair of spaced plates 78 on slide plate 80 on the left-hand side of support plate 14. Mounted on the forward end of each of the rods 74, 76 is a folder 84. Folder 84 includes a downwardly projecting substantially C-shaped plate for contact with opposite transverse ends of belt loop 40 supported on platform 73 to bend the ends of the belt loop back upon itself as illustrated in phantom in FIG. 7. In order to bend the belt loop 40 positioned on platform 73 back upon itself, the downwardly projecting C-shaped plates 84 must be rotated in opposite directions about the axis of its respective mounting rod 74, 76.

In order to rotate the C-shaped plates 84 about the axis of each of the rods 74, 76, each of the rods carry a cam follower 86 adjacent its rear end. Cam followers 86 comprise stube shafts or pintles welded or otherwise fixed to each of the rods 74, 76 and are positioned in a spiral wound groove 88 cut in opposite flanges 90 and 92 of a substantially U-shaped cam plate 94 fixed to a slide rod assembly 96 slidable in a groove 98 formed in the slide plate 80 and support plate 14. Cam plate 94 and slide 96 are movable by an air cylinder 99 mounted beneath support plate 14 having a piston rod 100 connected to slide assembly 96. The cam plate 94, rods 74, 76 and support blocks 78 are housed within a shield 102.

Upon retraction of the piston rod 100 of air cylinder 99, cam plate 94 and slide rod assembly 96 is moved forwardly in slot 98. Movement of the cam plate 94 in a forward direction causes cam follower pintles 86 on relatively stationary rods 74, 76 to travel rearwardly along spiral slots 88 in the flanges 90 and 92, respectively, in cam plate 94, which will rotate rod 76 in a counter clockwise direction and rod 74 in a clockwise direction, as viewed in FIG. 7, causing the downwardly projecting C-shaped folding plates 84 to contact the opposite transverse ends of the belt loop 40 on platform 73 to turn the transverse ends back upon itself. Cam plate 94 continues its forward movement until slide rod assembly 96 contacts a stop 104 (FIG. 6) connected to the bottom of plate 80 in its path of movement adjacent one end of groove 98. Continued retraction of piston rod 100 causes slide rod assembly 96 to contact stop 104, wich arrests further rotation of the rods 74 and 76. However, the stop 104 is fixed by threaded fasteners 106 to slide plate 80. Upon continued retraction of piston rod 100 and contact of slide rod assembly 96 with stop 104, the slide plate 80 is thrust forward to deliver the folded belt loop 40 beneath the foot 105 of a sewing machine tacker 108 (see phantom lines in FIG. 5).

Figure 3:
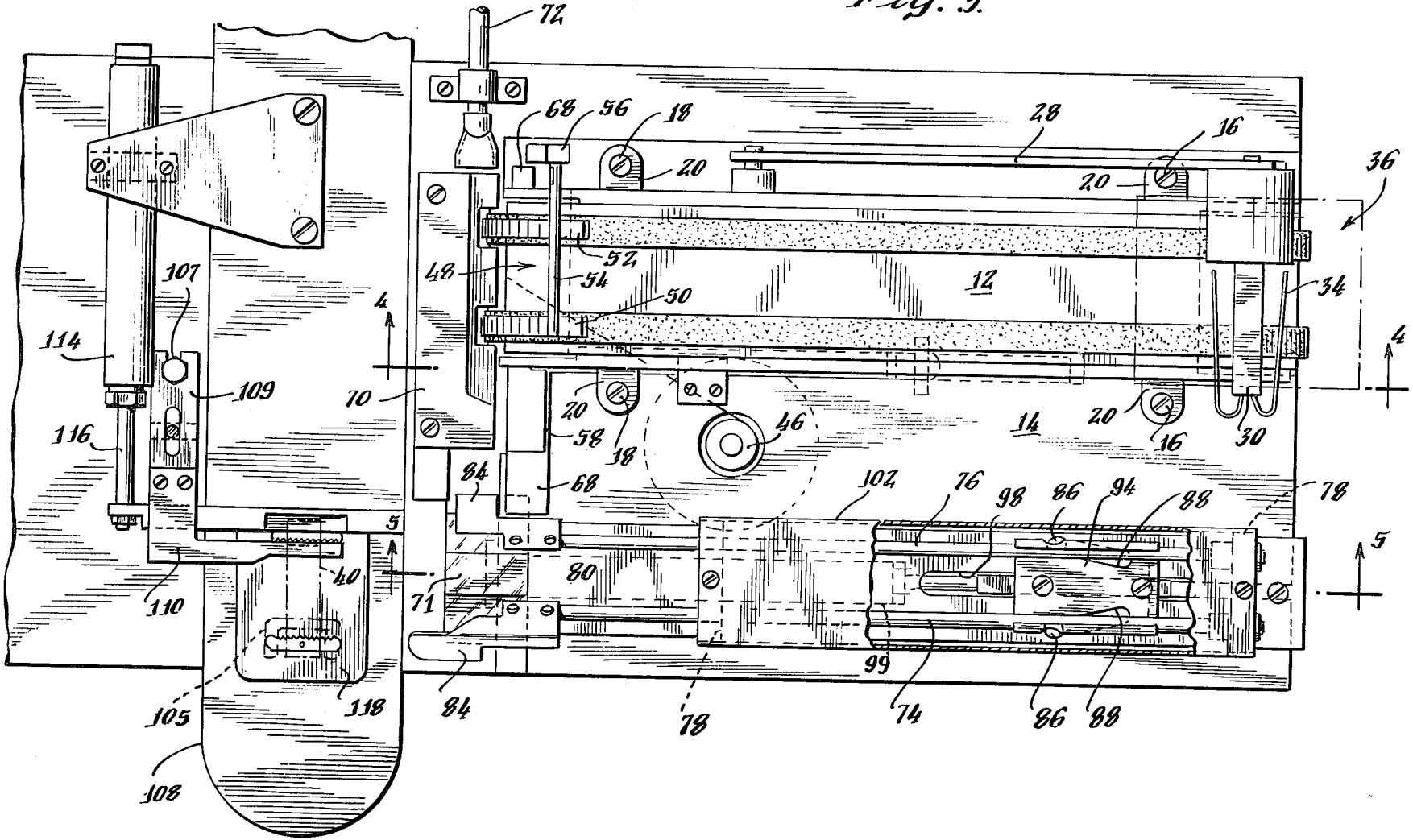
FIG. 3 is a top plan view of the apparatus of FIG. 1.

The motion of the folder mechanism 75 is then reversed. However, prior to the motion being reversed, a vertical air cylinder having a piston 107 connected to a plate 109 fixed to an L-shaped clamp 110 adjacent the foot 105 of the sewing machine tacker 108 is activated to pivot the L-shaped clamp 110 into clamping engagement with the belt loop 40 deposited on platform 118 adjacent sewing machine tacker 108. The L-shaped clamp 110 holds the upper end of the loop. The foot 105 of the tacker 108 descends (see FIG. 3) to hold the lower end of the loop before extension of rod 100.

Figure 5:
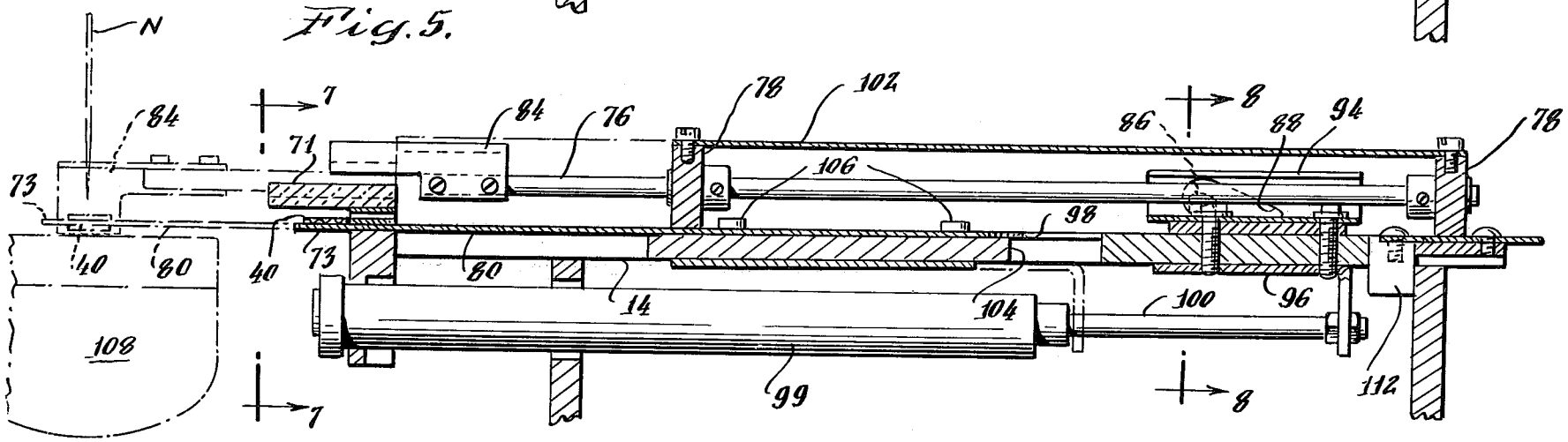
FIG. 5 is a cross-sectional view of the apparatus of the present invention taken substantially along the plane indicated by line 5—5 of FIG. 3.
Figure 6:
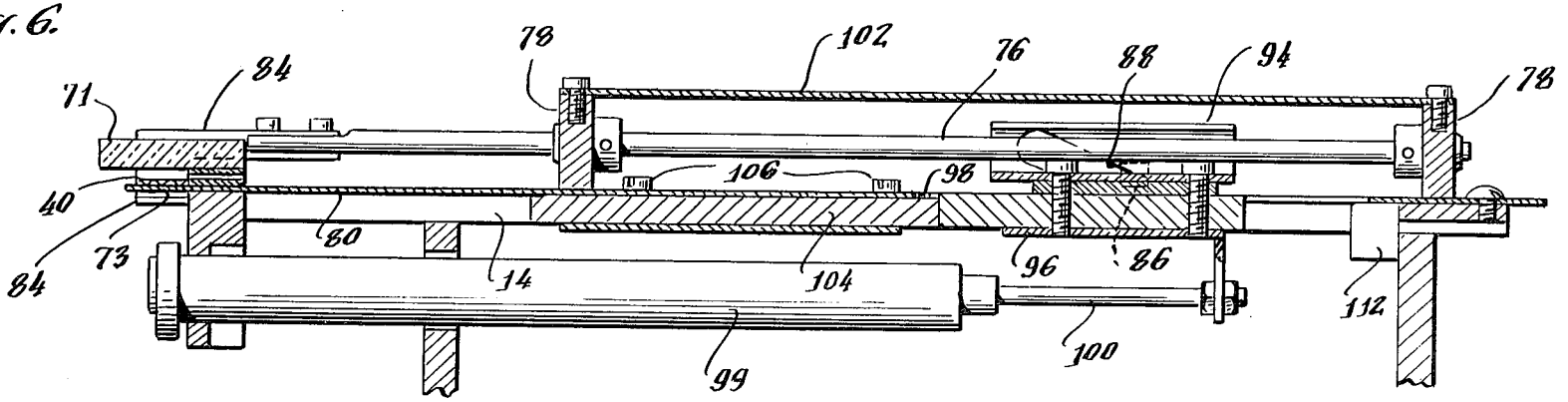
FIG. 6 is a view similar to FIG. 5, but in a different position of operation and use.
Figure 8:
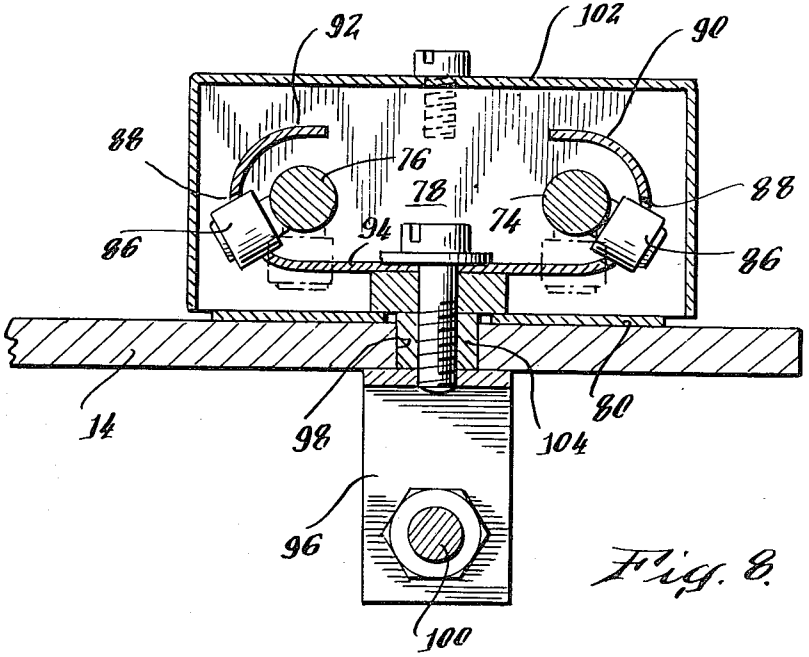
FIG. 8 is a cross-sectional view of the apparatus taken substantially along the plane indicated by line 8—8 of FIG. 5.

Once the belt loop 40 is deposited on platform 118 of the sewing machine 108 and clamped by L-shaped plate 110 and the foot 105 of the tacker, piston 100 of air cylinder 98 is extended. Extension of piston 100 causes rods 74 and 76 to first rerotate in a counter clockwise and clockwise manner, respectively, as viewed in FIG. 7 to release the folded belt loop 40. This is accomplished by cam plate 94 and slide rod assembly 96 moving to the right as viewed in FIGS. 5 and 6, causing cam plate 94 to move to the right leaving stop 104, while slide plate 80 is stationary. Movement of cam plate 94 to the right will cause relatively stationary cam follower pintles 86 on rods 74, 76 to follow grooves 88 to rotate the downwardly extending folder plates 84 in an opposite manner dropping the folded belt loops on platform 118 of the sewing machine 108. Continued movement of cam plate 94 to the right relative to rods 74, 76 will cause the cam plate 94 to contact a second stop 112 connected to slide plate 80 beneath the opposite end of slot 98, as shown in FIG. 5. Contact of cam plate 94 with the second stop 112 will return slide plate 80 to its initial position upon continued extension of piston 100.

Figure 2:
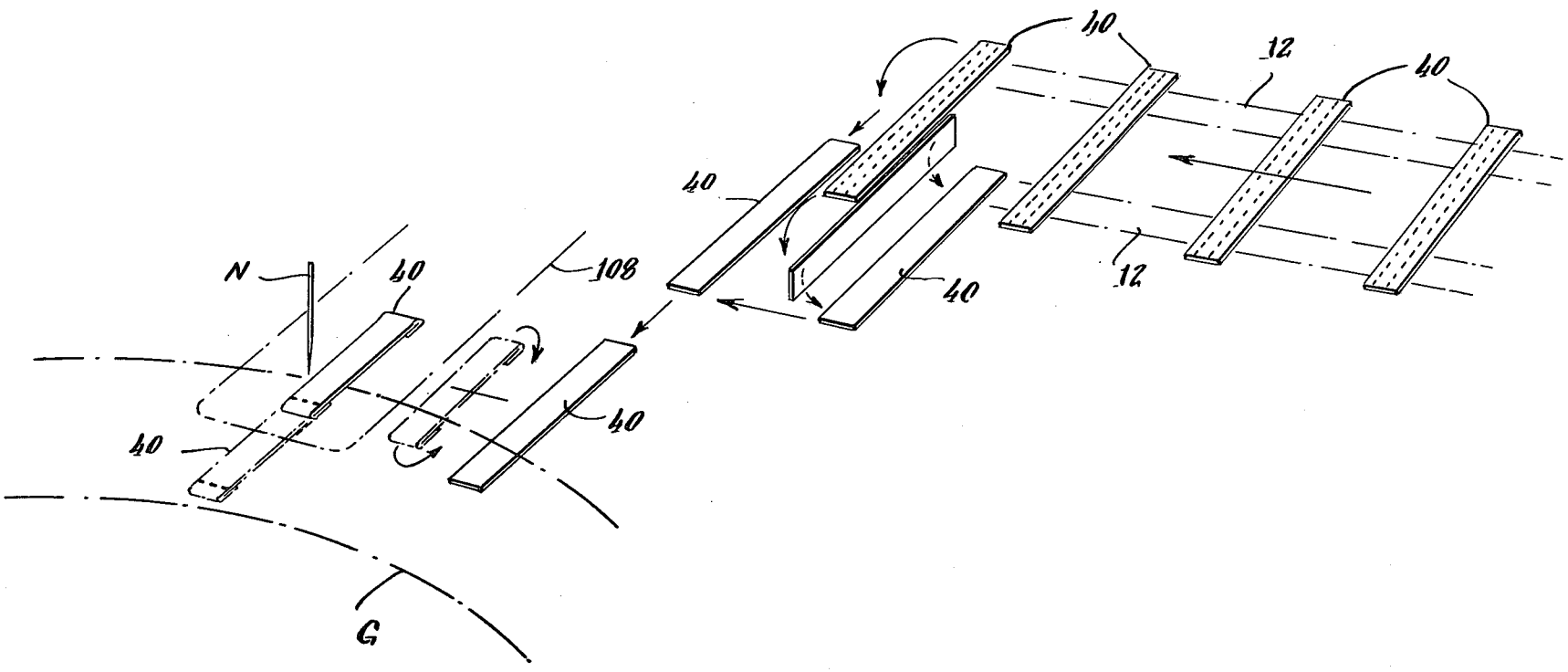
FIG. 2 is a schematic perspective view illustrating the folding and tacking of a belt loop utilizing the apparatus of FIG. 1.

With the folded belt loop 40 positioned on platform 118 of the sewing machine 108, the sewing machine needle N is adapted to tack one end of the folded loop 40 to the waist of a garment G draped between platform 118 and loop 40, as indicated in phantom in FIGS. 2 and 5. After tacking the same, the foot 105 is raised and a horizontal air cylinder 114 is activated to extend its piston 116 connected to platform 118. This repositions the opposite transverse end of the loop 40 beneath the needle N of the sewing machine 108 so that it can be tacked to the garment G. Retraction of pistons 116 and 107 and thus, clamp plate 110, enables the garment G to be repositioned by the operator to receive the next loop 40 to be tacked to the garment.

FIG. 2 summarizes the operation and process of the apparatus 10. Belt loops 40 are transported by conveyor belt 12 to L-shaped slide plate 58. Slide plate 58 moves the loops 40 into the enclosure formed by block 70 and L-shaped plate 58 wherein they are blown transversely onto platform 73 adjacent the folder apparatus. The ends of the belt loop 40 are folded by retraction of piston 100 causing the downwardly extending folder fingers 84 to fold the transverse ends of the loop 40 back upon itself. Slide rod assembly 96 is then moved forwardly in groove 98 until it abuts stop 104 to move the plate 80 forwardly to deposit the folded loop 40 on the platform 118 of the sewing machine 108 on the waist portion of garment G. After retraction of plate 80 and counter rotation of fingers 84 to drop loop 40 on platform 118, needle N is activated to tack one end of the folded loop to the garment. The vertical clamp plate 110 holds the loop to the garment after it has been deposited on the platform 118. Horizontal piston 116 is then extended to move the other transverse end of the loop 40 beneath needle N and it is also tacked to the garment.

What is claimed as new is as follows:

1. Apparatus for sewing a belt loop to a garment comprising:

folding means for folding opposite transverse ends of said belt loop back upon itself, means for feeding an unfolded belt loop on a support adjacent said folding means, and sewing means for tacking a folded belt loop to a garment, said folding means including means for reciprocating said folding means to deliver a folded belt loop beneath said sewing means for tacking the folded belt loop to a garment; and said sewing means including means for successively positioning the transverse ends of said belt loop beneath said sewing means so that the transverse ends can be sewn to a garment.

2. Apparatus in accordance with claim 1 wherein said feed means includes guide means for turning said individual belt loops upside down.

3. Apparatus in accordance with claim 1 wherein said feed means includes a reciprocable slide plate for receiving a belt loop, a fixed block adapted to mesh with said slide block to form an enclosure having open transverse ends, and air conduit means adjacent one of said open transverse ends in said enclosure for dispensing air into said enclosure to blow a belt loop therein out the other transverse open end of said enclosure onto a support adjacent said folding means.

4. Apparatus in accordance with claim 1 wherein said folding means includes a pair of parallel rods;

a folder finger on one end of each of said rods, a reciprocable cam plate, cam follower means between each of said rods and said cam plate for rotating said rods simultaneously in opposite directions about their longitudinal axes to fold opposite transverse ends of said belt loop back upon itself.

5. Apparatus in accordance with claim 1 wherein said sewing means includes a platform, means for clamping a folded belt loop on said platform, and means for moving said platform transversely with respect to said sewing means in order to sew opposite transverse ends of a belt loop to a garment.

6. Apparatus in accordance with claim 4 including a spiral camming slot on opposite sides of said cam plate, said cam follower means including a pintle on each rod received in one of said spiral slots in said cam plate whereby relative movement of said cam plate with respect to said support plate and rods will cause rotation of said rods, and said means for reciprocating said folding means includes a reciprocating support plate mounting said parallel rods having an elongated slot therethrough, means mounting said cam plate in said slot for relative movement with respect to said support plate, stop means connected to said support plate adjacent opposite ends of said slot positioned in the path of movement of said cam plate for contact with said cam plate so that continued movement of said cam plate after contact with said stop means causes movement of said support plate, and motor means connected to said cam plate for reciprocably driving said cam plate.

7. Apparatus in accordance with claim 1 wherein said feed means includes an endless conveyor belt.

8. Apparatus in accordance with claim 1 wherein said feed means includes an endless conveyor belt, guide means associated with said conveyor belt for turning individual belt loops upside down, a reciprocable slide plate for receiving said belt loops from said guide means, a fixed block adapted to mesh with said slide block to form an enclosure having open transverse ends, and air conduit means adjacent one of said open transverse ends in said enclosure for dispensing air into said enclosure to blow a belt loop therein out the other transverse open end of said enclosure onto a support adjacent said folding means.

9. Apparatus in accordance with claim 8 wherein said folding means includes a pair of parallel rods, a folder finger on one end of each of said rods a reciprocable cam plate, cam follower means between each of said rods and said cam plate for rotating said rods simultaneously in opposite directions about their longitudinal axes to fold opposite transverse ends of said belt loop back upon itself.

10. Apparatus in accordance with claim 9 including a spiral camming slot on opposite sides of said cam plate, said cam follower means including a pintle on each rod received in one of said spiral slots in said cam plate whereby relative movement of said cam plate with respect to said support plate and rods will cause rotation of said rods, and said means for reciprocating said folding means includes a reciprocating support plate mounting said parallel rods having an elongated slot therethrough, means mounting said cam plate in said slot for relative movement with respect to said support plate, stop means connected to said support plate adjacent opposite ends of said slot positioned in the path of movement of said cam plate for contact with said cam plate so that continued movement of said cam plate after contact with said stop means causes movement of said support plate, and motor means connected to said cam plate for reciprocably driving said cam plate.

11. Apparatus in accordance with claim 10 wherein said sewing means includes a platform, means for clamping a folded belt loop on said platform and means for moving said platform transversely with respect to said sewing means in order to sew opposite transverse ends of a belt loop to a garment.

* * * * *